US007712236B2

(12) United States Patent
Ball et al.

(10) Patent No.: US 7,712,236 B2
(45) Date of Patent: May 11, 2010

(54) APPARATUS AND METHOD FOR RELEASABLY HOLDING FABRIC IN PLACE ON AN IRONING BOARD OR THE LIKE

(75) Inventors: Charles Peter Ball, Newport, RI (US); Claire Marie Ball, Newport, RI (US)

(73) Assignee: Charles P. Ball, Waterford, ME (US)

( * ) Notice: Subject to any disclaimer, the term of this patent is extended or adjusted under 35 U.S.C. 154(b) by 223 days.

(21) Appl. No.: 11/982,225

(22) Filed: Nov. 2, 2007

(65) Prior Publication Data

US 2009/0113771 A1 May 7, 2009

(51) Int. Cl.
*D06F 85/00* (2006.01)
*D06F 83/00* (2006.01)
*D06F 81/00* (2006.01)

(52) U.S. Cl. ..... 38/12; 38/141; 38/140; 15/268

(58) Field of Classification Search ..... 38/1 R, 38/12–17, 64, 66, 69, 70, 140, 141; 15/1, 15/268
See application file for complete search history.

(56) References Cited

U.S. PATENT DOCUMENTS 1,560,191 A * 11/1925 Allen ..... 38/108
1,624,829 A * 4/1927 Dawn ..... 38/108
2,286,348 A * 6/1942 Custer ..... 38/12
2,437,084 A * 3/1948 Esecson ..... 38/12
2,517,331 A * 8/1950 McCauley ..... 38/12
3,579,877 A * 5/1971 Bray, Jr. ..... 38/12
6,324,776 B1 * 12/2001 Miyata ..... 38/12

* cited by examiner

*Primary Examiner*—Ismael Izaguirre

(57) ABSTRACT

An apparatus and method to quickly, easily and temporarily secure fabric to an ironing board or the like to facilitate the removal of hair, lint, or other particulate matter which is adhered to the surface of the fabric. The fabric to be cleaned is positioned on an ironing board in the same manner as placing the fabric on the board for ironing. A pressure applying member is placed over the fabric to be cleaned, most commonly near the longitudinal end of the fabric. Each end of the pressure applying member is connected to a tension mechanism such as a spring or elastomeric cord. The other end of the tension mechanism is connected, in turn, to a connecting means such as a J-hook. When the connecting means are hooked over the far and near edges of the ironing board, the tension mechanism is pulled taut, forcing the pressure member down with sufficient force to hold the fabric in place against the pull of a vacuum or lint brush.

13 Claims, 6 Drawing Sheets

APPARATUS AND METHOD FOR RELEASABLY HOLDING FABRIC IN PLACE ON AN IRONING BOARD OR THE LIKE

BACKGROUND OF THE INVENTION

The present invention comprises an apparatus and method for quickly and releasably attaching fabric to an ironing board or the like to hold the fabric in place to facilitate the removal of pet hair, lint and other detritus by vacuum, lint brush or any other means that would exert a force on the fabric sufficient to cause the fabric to lift and bunch.

In addition to providing a surface to iron clothes and other fabrics, an ironing board also provides a convenient surface for the removal of unwanted hair, lint and other detritus from these same fabrics. Unfortunately, without suitable means for holding the fabric in place on the surface of the ironing board, a vacuum cleaner will lift and bunch the fabric. This movement makes the cleaning process extremely difficult. Likewise, the lint brush has nearly identical problems. If the operator holds one end of the fabric with one hand and the lint brush in the other hand, the brush can only be stroked in one direction. When the operator tries to stroke the clothing in the reverse direction, once again, the fabric lifts and bunches.

In both cases, the cleaning process needs a "third hand" or other means to secure the fabric. The apparatus and method of this invention eliminates the need for that third hand. It holds the fabric or article of clothing in place while it is being cleaned with a vacuum cleaner or lint brush.

There is no prior art known to the inventor relating to apparatus and methods for quickly and temporarily securing clothing and other fabrics to an ironing board for the purpose of assisting in the removal of hair, lint and other unwanted detritus.

BRIEF SUMMARY OF THE INVENTION

The present invention relates to an apparatus and method that utilizes a pressure applying member, a tensioning means and a connecting means, in combination, to produce a force that can be quickly, easily and temporarily applied to an ironing board or the like to hold a fabric in place on the surface of the ironing board. The primary objective of the invention is to provide assistance in holding fabric in place on the ironing board while the fabric is being vacuumed or brushed in order to remove pet hair and lint from the fabric. Secondarily, if so desired, the pressure apparatus can provide assistance to the ironing process.

In practice, the pressure applying member is placed over the fabric to be cleaned, most commonly near the longitudinal end of the fabric. The pressure applying member is connected to a tensioning means such as a spring or elastomeric cord. The tensioning means is attached, in turn, to a connecting means such as a J-hook or an S-hook. The connecting means are then hooked over the far and near edges of the ironing board. Attaching the hooks pulls the tensioning means taut, forcing the pressure member down with sufficient force to hold the fabric in place against the pull of the vacuum or lint brush.

DETAILED DESCRIPTION OF THE INVENTION

Figure 1A:
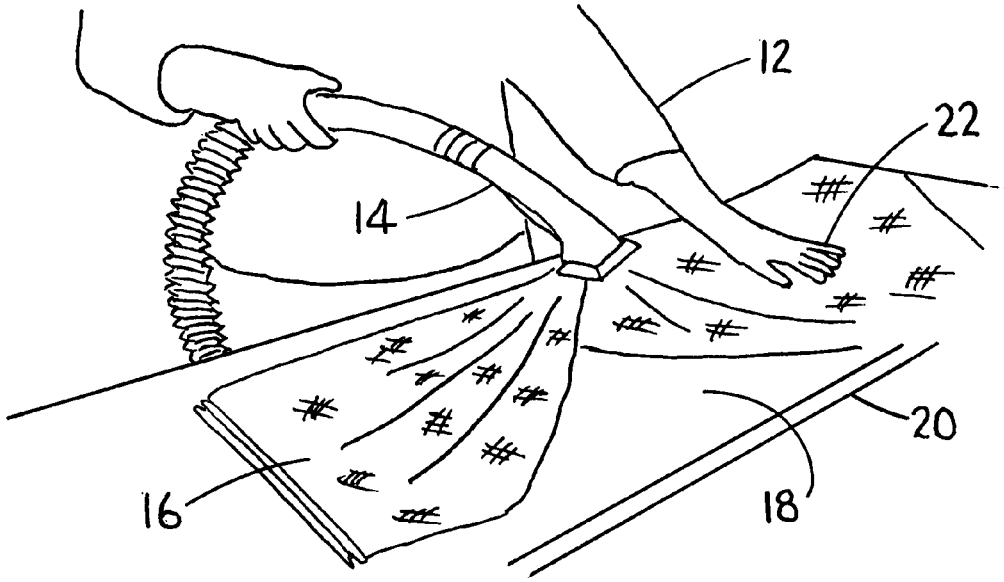
FIG. 1A is a perspective view of a person vacuuming hair and lint off a pair of slacks without the aid of the pressure applying apparatus of this invention.
Figure 1B:
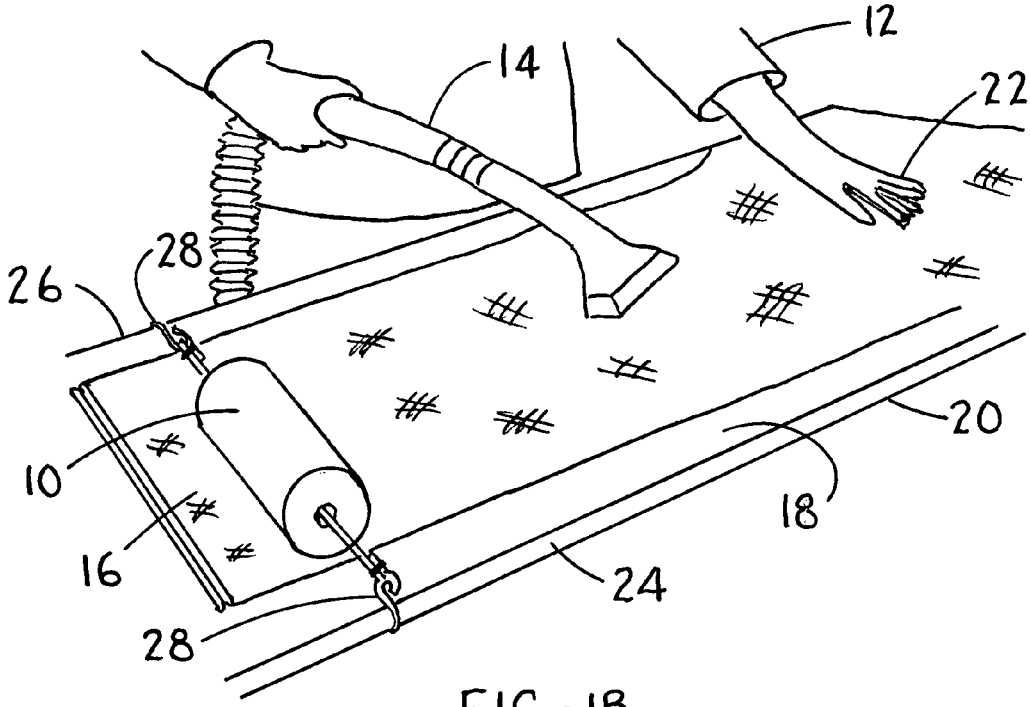
FIG. 1B is a perspective view of a person vacuuming hair and lint off a pair of slacks with the aid of the pressure applying apparatus of this invention.

Referring to FIG. 1A of the drawings, there is shown a person 12 using a vacuum cleaner 14 and one hand 22 to try to vacuum a fabric 16 on the substantially planar surface 18 of an ironing board 20 without the benefit of the pressure applying apparatus 10 of this invention as shown in FIG. 1B. As is readily apparent the fabric 16 is lifted from the surface 18 of the ironing board 20 by the force of the vacuum and bunches despite being held down in one place by the hand 22.

Referring now to FIG. 1B, there is shown the person 12 vacuuming the fabric 16 on the surface 18 of the ironing board 20 using the pressure applying apparatus 10 of this invention and one hand 22 to hold the fabric 16 in place. As is readily apparent, the fabric 16 is easily held in place on the surface 18 of the ironing board 20 against the force of the vacuum when the vacuum 14 is applied to the fabric 16 in the area between the pressure applying apparatus 10 of this invention and the hand 22 of person 12 holding the fabric 16. The pressure applying apparatus 10 of this invention will be subsequently described in detail herein and is shown as having connecting means 28 for engaging defined edge surfaces 24, 26 respectively of ironing board 20. Although the pressure applying apparatus 10 of this invention is shown in use with ironing board 20, it will be readily understood that the pressure applying apparatus 10 could also be used with a table or the like having a substantially planar surface defined by edge surfaces to which the apparatus 10 could be releasably connected.

Figure 2:
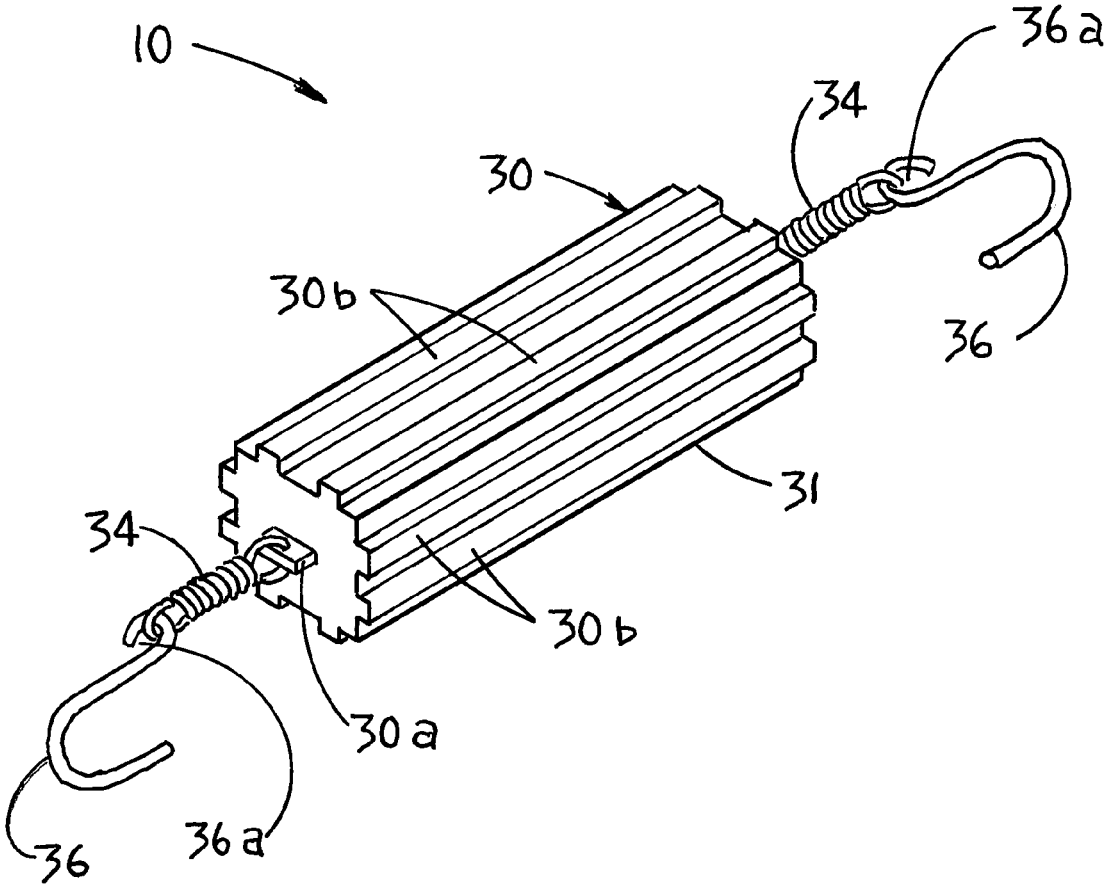
FIG. 2 is a perspective view of one embodiment of the pressure applying apparatus of this invention in which the pressure applying member comprises a rectangular hollow plastic tube, the tensioning means comprises an expansion spring and the connecting means comprises a metal S-hook.

Referring now to FIG. 2 of the drawings, there is shown one embodiment for the pressure applying apparatus 10 of this invention. The pressure applying apparatus 10 includes a pressure applying member 30 comprising a high-temperature (400° F.) injection molded hollow plastic (e.g. Solvay R polyphenylsulfone) rectangular shaped tube 31 that may be 1" (25 mm)×1.25" (31 mm) in cross-section. Means for tensioning the pressure applying member 30 includes eyelets 30*a* that are preferably integrally formed respectively on each end of the plastic tube 31 by injection molding or any other means as is well known in the art. The plastic tube 31 including the eyelets 30*a* may be 5.5 inches in length (24 cm) although the invention is not limited to this length and material and other lengths and materials may also be suitable. The rectangular cross-section of the pressure applying member 30 inherently provides two pressure levels depending in which lineal surface of the plastic tube 31 is in contact with the horizontal planar surface 18. The outer longitudinal surface of the plastic tube 31 preferably has friction ridges 30*b* protruding from the surface thereof along substantially the length of the tube. The friction ridges 30*b* provide additional gripping force to hold the fabric in place. The tensioning means for resiliently biasing the pressure applying member 30 further includes expansion spring members 34 attached respectively to the eyelets 30*a* at the ends of the plastic tube 31. The expansion spring members 34 may be ¼ inches in diameter (6 mm) with a length of 2 inches (50 mm). The other ends of the expansion spring members 34 attach respectively to means for releasably connecting to the edge surfaces 24, 26 comprising hooks 36 which may be S-hooks or any other type of suitable hook such as J-hooks. The hooks 36 may be made from stainless steel and have a large hook opening of 1⅜ inches (35 mm). The lower arm of the hooks 36 need be only ½ inches (12 mm) in length while the upper arm of the hooks 36 is typically 1 inch (25 mm) in length. The upper arm of the hooks 36 includes an eyelet 36*a* approximately ¼ inches (6 mm) in diameter. The expansion springs 34 are attached to the hooks 36 respectively at the eyelets 36*a*. It will be readily understood that such spring members may comprise elastomeric cords such as bungee cords or any other type of resilient stretchable material. The invention is not limited to the above materials and dimensions and other materials and dimensions may be used as will be well understood in the art.

Figure 3:
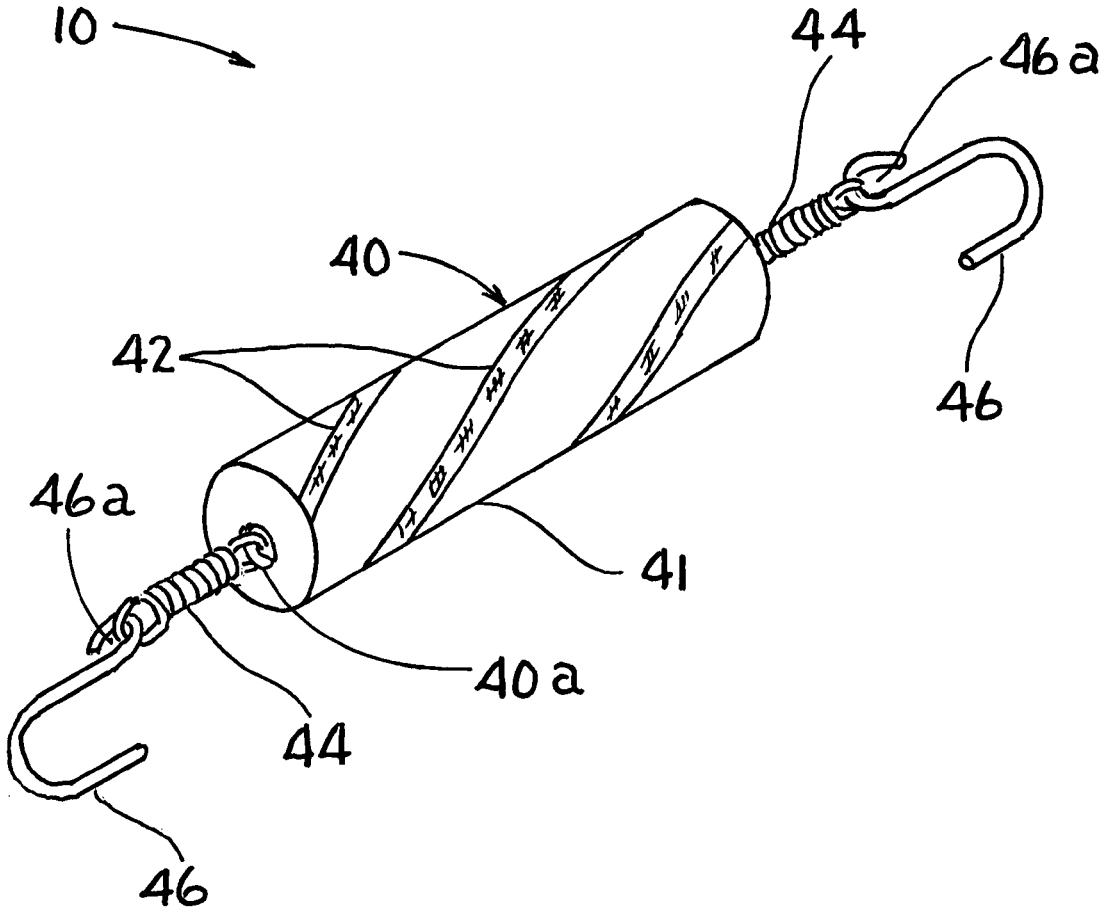
FIG. 3 is a perspective view of another embodiment of the pressure applying apparatus of this invention in which the pressure applying member comprises a cylindrical wooden block, the tensioning means comprises an expansion spring and the connecting means comprises a metal S-hook.

Referring now to FIG. 3 of the drawings, there is shown another embodiment for the pressure applying apparatus 10 of this invention. The pressure applying apparatus 10 includes a pressure applying member 40 comprising an elongated cylinder 41 preferably made of wood 1.5 inches (37 mm) in diameter. The elongated cylinder 41 may be 5 inches in length (13 cm) although the invention is not limited to this length and material and other lengths and materials may also be suitable. The surface of the elongated cylinder 41 has helical ridges 42 protruding from the surface thereof and extending substantially the length thereof to increase the friction between the elongated cylinder 41 and the fabric. These ridges 42 may consist of Velcro strips cemented to the surface of the elongated cylinder 41 to increase friction between the pressure applying member 40 and the fabric. Means for resiliently biasing the pressure applying member 40 comprises a pair of eyelets 40*a* that are attached respectively to each end of the cylinder 41 at the longitudinal axis of thereof. The eyelets 40*a* are preferably countersunk into the cylinder 41 for added strength. The tensioning means for resiliently biasing the pressure applying member 40 also preferably comprises a pair of expansion spring members 44 attached respectively to the eyelets 40*a* at the ends of the cylinder 41. The expansion springs 44 may be ¼ inches in diameter (6 mm) with a length of 2 inches (50 mm). The other end of the expansion springs 44 attach respectively to means for releasably connecting to edge surfaces 24, 26 comprising hooks 46 which may be S-hooks or any other type of suitable hook such as J-hooks. The hooks 46 are preferably made from stainless steel and may have a large hook opening of 1⅜ inches (35 mm). The lower arm of the hooks 46 need be only ½ inches (12 mm) in length while the upper arm of the S-hooks 46 is typically 1 inch (25 mm) in length. The upper arm of the hooks 46 includes an eyelet 46*a* approximately ¼ inches (6 mm) in diameter. The expansion spring members 44 attach to the hooks 46 respectively at the eyelets 46*a*. The expansion springs 34 are attached to the hooks 36 respectively at the eyelets 36*a*. It will be readily understood that such spring members may alternatively comprise elastomeric cords such as bungee cords or any other type of resilient stretchable material. Again, the invention is not limited to the above materials and dimensions and other materials and dimensions may be used as will be well understood in the art.

Figure 4:
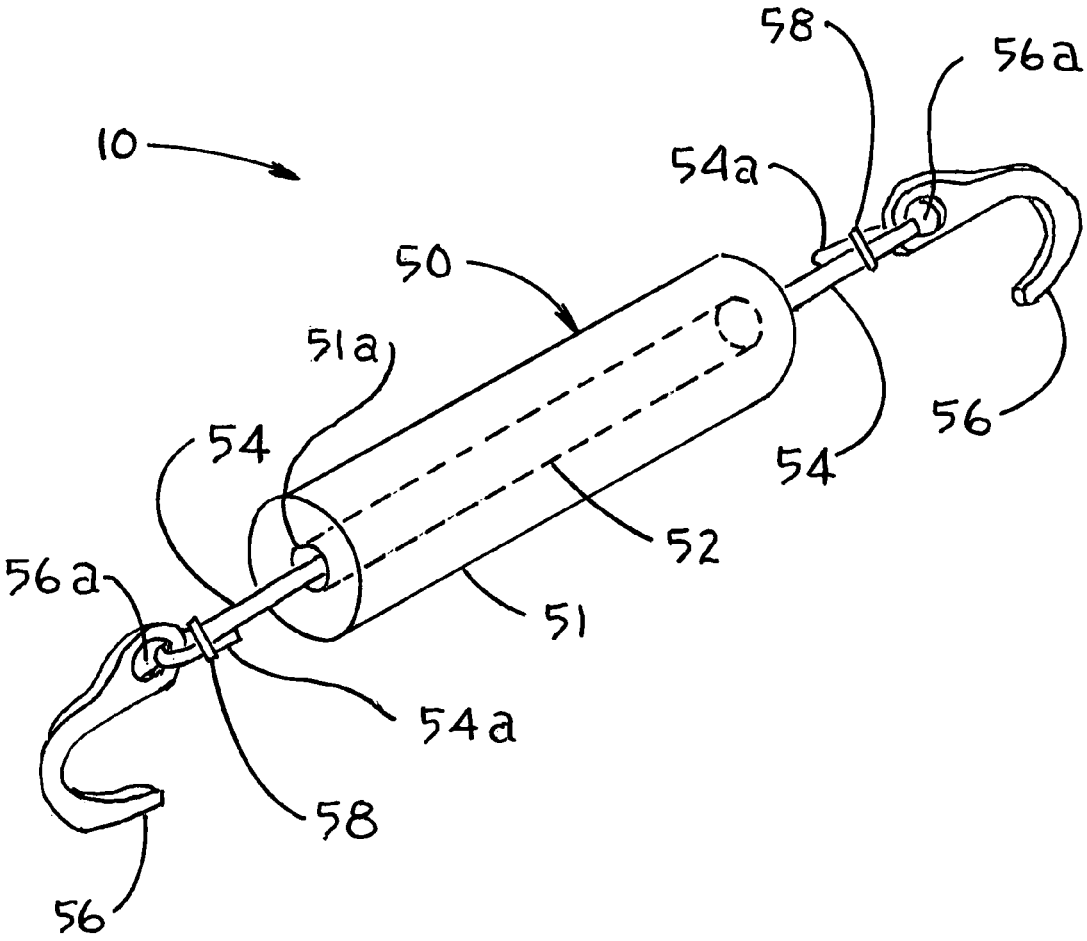
FIG. 4 is a perspective view of still another embodiment of the pressure applying apparatus of this invention in which the pressure applying member comprises a cylindrical foam rubber tube, the tensioning means comprises an elastomeric cord and the connecting means comprises a plastic J-hook.

Referring now to FIG. 4 of the drawings, there is shown still another embodiment for the pressure applying apparatus 10 of this invention. The pressure applying apparatus 10 includes a pressure applying member 50 comprising a cylindrical foam rubber tube 51. The tube 51 is preferably made of a high temperature (300° F.-400° F.) material (e.g. Armacell HT/Armaflex) that will not melt if it comes in contact with a hot iron. The foam rubber tube 51 has a center hole 51*a* extending the length thereof that may be ⅜ inches in diameter (10 mm) and a wall thickness that may be ¾ inches (18 mm). The foam rubber is relatively soft with a non-polished surface suitable for gripping the fabric. The foam rubber tube 51 may be 5 inches (13 cm) in length. A ⅜" O.D. PVC or copper pipe 52 is preferably inserted in the center hole 51*a* of the foam rubber tube 51 to stiffen the tube 51 along its length. Tensioning means for resiliently biasing the pressure applying member 50 comprises an elastomeric cord 54 threaded through the center hole 51*a* of the foam rubber tube 51. The elastomeric cord 54 may be ⅜ inches in diameter (10 mm) cut to a length of 10 inches (26 mm). Although an elastomeric cord is shown, the invention is not so limited and other types of spring members as previously discussed can also be used as will be well understood in the art. The ends of the elastomeric cord 54 attach to means for releasably connecting to the edge surfaces 24, 26 comprising hooks 56. The hooks 56 may be made from hard plastic having a hook opening of 1⅜ inches (35 mm). The lower arm of the hooks 56 need be only ½ inches (12 mm) in length while the upper arm of the hooks 36 is typically 1 inch (25 mm) in length. The upper arm of the hooks 36 also includes an eyelet 56*a* approximately ⅜ inches (10 mm) in diameter. The eyelets 36*a* provide a means for connecting the ends of the elastomeric cord 54 to the J-hooks 56. The ends of the elastomeric cord 54 are threaded respectively through the J-hook eyelets 56*a* and the outlet end portions 54*a* of the cord are crimped respectively onto the input portions of the cord 54 using 3/16 inch C-staple 58. Again, the invention is not limited to the above materials and dimensions and other materials and dimensions may be used as will be well understood in the art.

Figure 5:
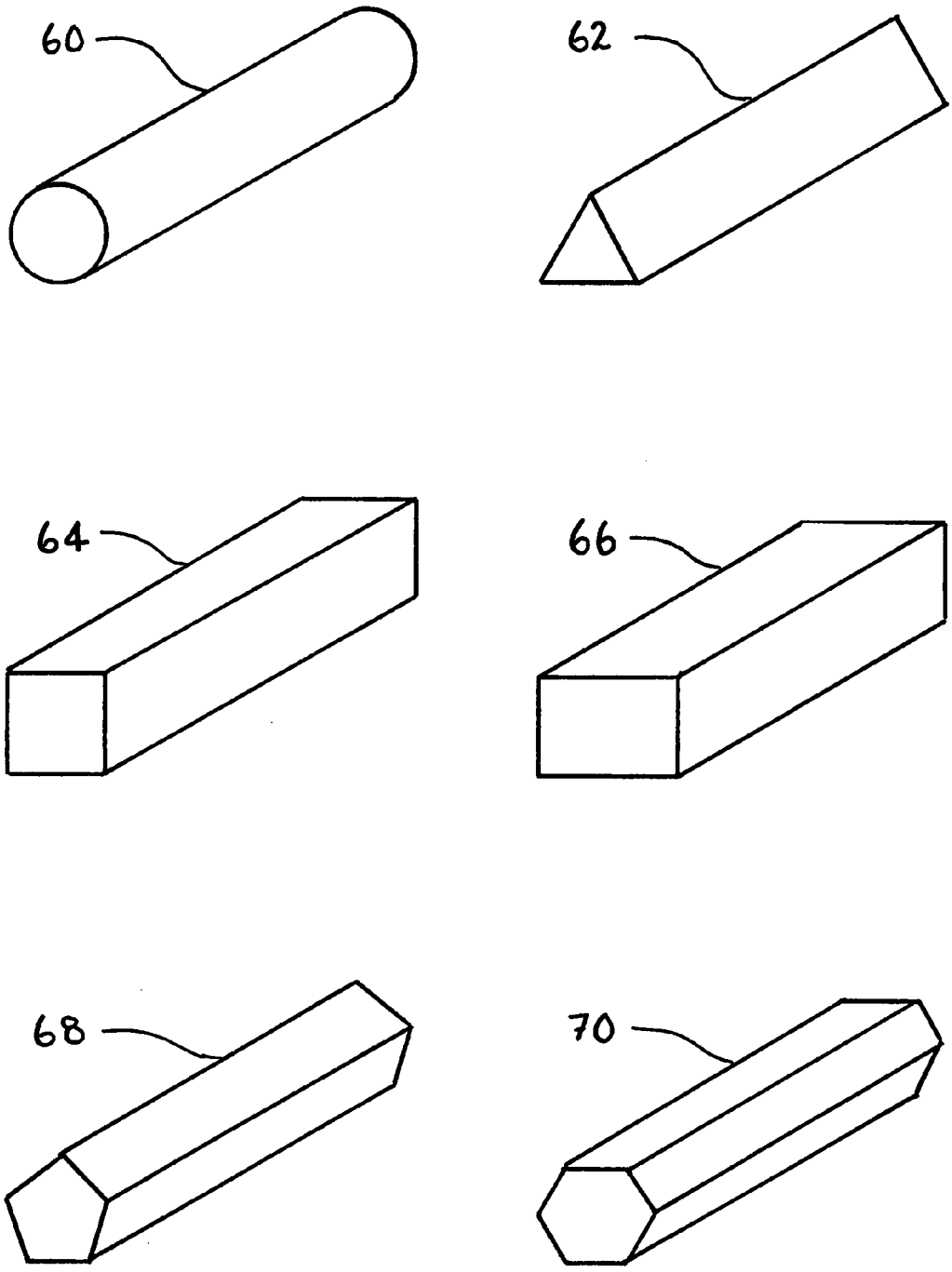
FIG. 5 is a perspective view of additional embodiments of the pressure applying member.

Referring now to FIG. 5 of the drawings, there is shown various embodiments for cross section of the pressure applying members including circular 60 and non-circular such as triangle 62, square 64, rectangle 66, pentagon 68, hexagon 70, etc. where the pressure applying surface is substantially planar along the length thereof. Pressure applying members may be solid or hollow depending on the material and strength design as will be well understood in the art. The pressure applying member can be constructed from a variety of materials including wood (e.g. maple, pine), metal (e.g. stainless steel, aluminum), plastic (high temperature), nylon (e.g. high temperature Amodel polyphthalamide), and rubber (foam and solid). To increase the coefficient of friction between the pressure applying member and the fabric to be held, the outer surface of the pressure member may be scoured, dimpled, have longitudinal friction strips attached, or be constructed with friction ridges both spiral and longitudinal.

Figure 6:
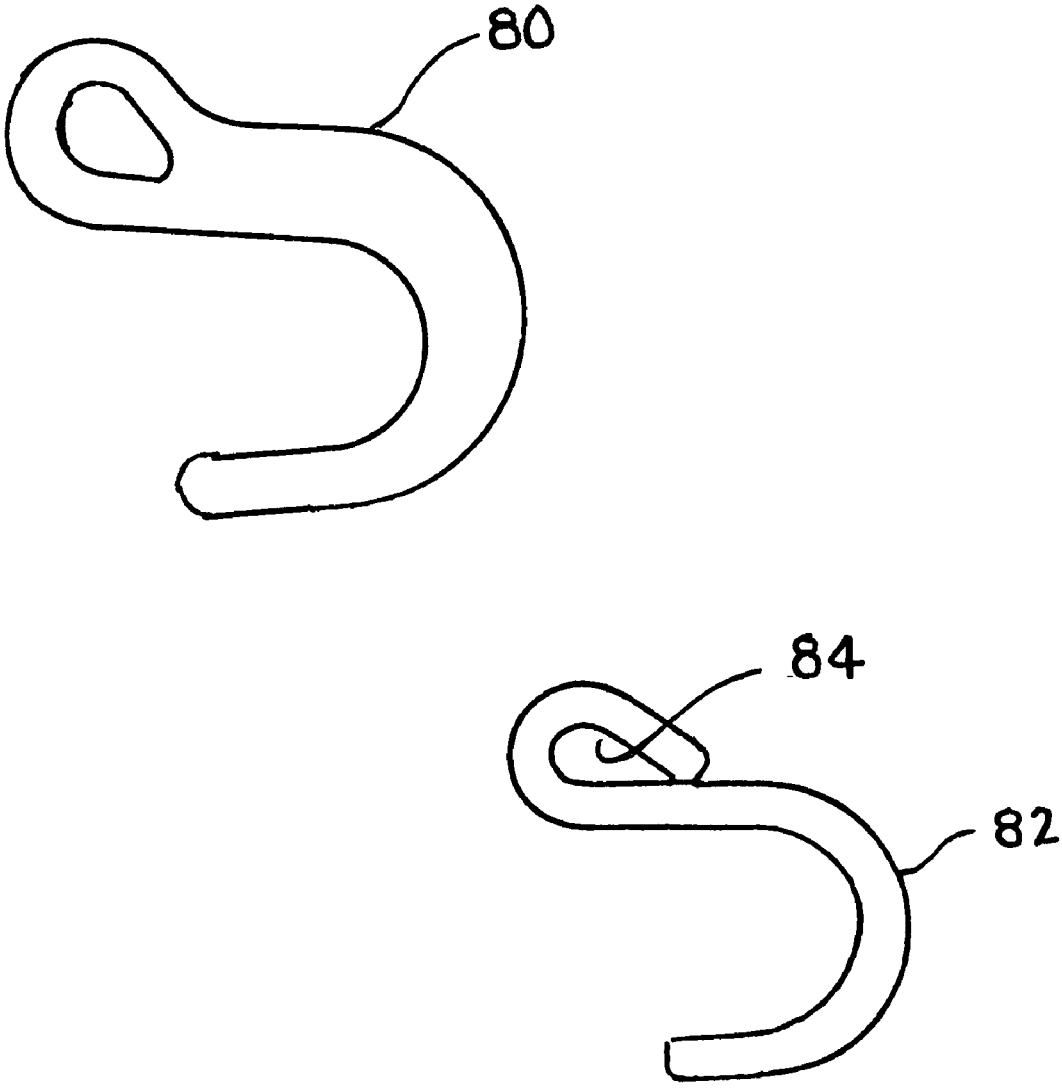
FIG. 6 is a perspective view of additional embodiments of the attaching means.

Referring now to FIG. 6 of the drawings, there is shown alternate embodiments for the connecting means. The hooks may be constructed of metal or plastic. They are basically J-hook 80 or S-hook 82 with an eyelet 84 inherent in the design for attaching to the tensioning means.

With respect to the above descriptions, it is to be realized that the optimum dimensional relationship for the parts of the invention, to include variation in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. Apparatus for releasably securing a fabric to a substantially planar surface between defined edge surfaces to facilitate cleaning of the fabric by means such as vacuuming or brushing comprising:

an elongated pressure applying member defining a pressure applying surface, means for tensioning the pressure applying member against the substantially planar surface so as to retain the fabric in fixed position on the substantially planar surface when the fabric is placed between the pressure applying surface of the pressure applying member and the substantially planar surface, and means for releasably connecting the tensioning means to the substantially planar surface substantially at the edges thereof wherein the means for tensioning comprises a pair of eyelets attached respectively to the ends of the elongated pressure applying member and a pair of resilient members each attached at one end respectively to the eyelets, and the means for releasably connecting comprises a pair of hook members attached respectively to the other ends of the resilient members for releasable engagement respectively with the edge surfaces.

2. The apparatus of claim 1 wherein the pressure applying member comprises an elongated cylinder.

3. The apparatus of claim 2 wherein the elongated cylinder has a helical ridge protruding from the surface thereof and extending substantially the length thereof.

4. The apparatus of claim 3 wherein the eyelets are countersunk into the ends of the elongated cylinder respectively.

5. The apparatus of claim 3 wherein the elongated cylinder is a plastic tube having molded end portions to which the eyelets are attach respectively.

6. The apparatus of claim 1 wherein the cross section of the pressure applying member includes a linear portion defining the edge of the pressure applying surface of the pressure applying member which is substantially planar extending longitudinally along the length of the pressure applying member.

7. The apparatus of claim 6 where the pressure applying surface has friction ridges protruding from the pressure applying surface along substantially the length thereof.

8. Apparatus for releasably securing a fabric to a substantially planar surface between defined edge surfaces to facilitate cleaning of the fabric by means such as vacuuming or brushing comprising:

an elongated pressure applying member defining a pressure applying surface, means for tensioning the pressure applying member against the substantially planar surface so as to retain the fabric in fixed position on the substantially planar surface when the fabric is placed between the pressure applying surface of the pressure applying member and the substantially planar surface, and means for releasably connecting the tensioning means to the substantially planar surface substantially at the edges thereof wherein the pressure applying member has an opening extending longitudinally thru the center thereof and the means for tensioning extends thru the longitudinal opening connecting to the means for releasably connecting on both ends of the pressure applying member.

9. The apparatus of claim 8 wherein the means for resiliently biasing comprises an elongated elastomeric material.

10. The apparatus of claim 9 wherein the means for releasably connecting comprises a pair of hooks connected respectively to the ends of an elongated elastomeric cord for releasable engagement with the defined edge surfaces.

11. The apparatus of claim 10 wherein the pressure applying member comprises a high temperature foam rubber material thru which a longitudinal opening extends and an elongated rigid tube extending the length of the opening to stiffen the foam rubber material.

12. A method for releasably securing a fabric to a substantially planar surface between defined edge surfaces to facilitate the cleaning of the fabric comprising the steps of:

placing one surface of the fabric in direct contact with a select portion of the substantially planar surface, placing the pressure applying surface of a pressure applying member on the opposite surface of the fabric from that surface which is in direct contact with the substantially planar surface, and tensioning the pressure applying member against the fabric so as to retain the fabric in fixed position on the substantially planar surface wherein the step of tensioning the pressure applying member against the fabric comprises the steps of connecting a pair of hooks connected respectively to the ends of a pair of resilient members connected to the ends of the pressure applying member respectively to engage the defined edge surfaces respectively of the substantially planar surface.

13. A method for releasably securing a fabric to a substantially planar surface between defined edge surfaces to facilitate the cleaning of the fabric comprising the steps of:

placing one surface of the fabric in direct contact with a select portion of the substantially planar surface, placing the pressure applying surface of a pressure applying member on the opposite surface of the fabric from that surface which is in direct contact with the substantially planar surface, and tensioning the pressure applying member against the fabric so as to retain the fabric in fixed position on the substantially planar surface wherein the step of tensioning the pressure applying member against the fabric comprises the steps of connecting a pair of hooks connected respectively to the opposite ends of an elongated elastomeric cord extending thru an opening thru the center of the pressure applying member to engage the defined edge surfaces respectively of the substantially planar surface.

* * * * *